US010722009B2

(12) United States Patent
Shah

(10) Patent No.: US 10,722,009 B2
(45) Date of Patent: Jul. 28, 2020

(54) COMPOSITE RECTANGULAR JEWELRY STRUCTURE

(71) Applicant: Amit Shah, Mumbai (IN)

(72) Inventor: Amit Shah, Mumbai (IN)

( * ) Notice: Subject to any disclaimer, the term of this patent is extended or adjusted under 35 U.S.C. 154(b) by 140 days.

(21) Appl. No.: 15/976,096

(22) Filed: May 10, 2018

(65) Prior Publication Data

US 2018/0325226 A1 Nov. 15, 2018

Related U.S. Application Data

(60) Provisional application No. 62/504,723, filed on May 11, 2017.

(51) Int. Cl.
*A44C 17/02* (2006.01)
*A44C 17/00* (2006.01)
*A44C 17/04* (2006.01)

(52) U.S. Cl.
CPC ..... *A44C 17/002* (2013.01); *A44C 17/02* (2013.01); *A44C 17/04* (2013.01)

(58) Field of Classification Search
CPC ..... A44C 17/002; A44C 17/02; A44C 17/04; A44C 17/003; A44C 17/00; A44C 9/00; A44C 17/046
USPC ..... 63/26–28; D11/92
See application file for complete search history.

(56) References Cited

U.S. PATENT DOCUMENTS 4,936,115 A * 6/1990 Mesica ..... A44C 17/02 63/26
9,351,546 B2 * 5/2016 Nevatia ..... A44C 17/00
2012/0006056 A1 * 1/2012 Mueller ..... A44C 17/006 63/27

OTHER PUBLICATIONS (Document 1) Kay Jewelers (author), Kay Jewelers catalog, 2015, Kaw Jewelers (publisher). Pages submitted: cover page of catalog, p. 30 of catalog, and back page of catalog.†
(Document 4), Shane Co. (author), Shane Co. Mother's Day catalog, 2016, Shane Co. (publisher). Pages submitted: cover page of catalog (color), penultimate page of catalog (color), and back page of catalog (color).†
(Document 5) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine, p. 11 of magazine, close up of item on p. 11 of magazine, table of contents of magazine, penultimate page of magazine showing date of upcoming convention, and back page of magazine.†
(Document 2) Kay Jewelers (author), Kay Jewelers catalog, 2015, Kaw Jewelers (publisher). Pages submitted: cover page of catalog (color), p. 30 of catalog (color), and back page of catalog (color).†

(Continued)

*Primary Examiner* — Jack W Lavinder
(74) *Attorney, Agent, or Firm* — Leason Ellis LLP

(57) ABSTRACT

A method for creating an apparent visual appearance of a large rectangular gemstone in a setting comprising the steps of: mounting a plurality of outer stones along sides and ends of a setting; and mounting a rectangular shaped center stone in a first plane that lies above a second plane that contains the plurality of outer stones, the center stone being disposed within a center of the plurality of outer stones and in a partially overlapping manner such that an appearance of the center stone and the underlying outer stones emulates an appearance of an emerald cut gemstone having larger dimensions than the center stone.

20 Claims, 6 Drawing Sheets

(56) References Cited

OTHER PUBLICATIONS (Document 3), Shane Co. (author), Shane Co. Mother's Day catalog, 2016, Shane Co. (publisher). Pages submitted: cover page of catalog, penultimate page of catalog, and back page of catalog.†
(Document 8) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine (color), p. 45 of magazine (color), close up of item on p. 45 of magazine (color), and back page of magazine (color).†
(Document 9) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine, p. 46 of magazine, close up of item on p. 46 of magazine, table of contents of magazine, penultimate page of magazine showing date of upcoming convention, and back page of magazine.†
(Document 6) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine (color), p. 11 of magazine (color), close up of item on p. 11 of magazine (color), and back page of magazine (color).†
(Document 7) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine, p. 45 of magazine, close up of item on p. 45 of magazine, table of contents of magazine, penultimate page of magazine showing date of upcoming convention, and back page of magazine.†
(Document 10) JCK Magazine (author), JCK Jewelers' Choice Awards, The Winners and Finalists of The 2016 Jewelers' Choice Awards, The Best of the Best, Mar. 25, 2016, JCK (publisher), New York, New York. Pages submitted: cover page of magazine (color), p. 46 of magazine (color), close up of item on p. 46 of magazine (color), and back page of magazine (color).†

* cited by examiner
† cited by third party

COMPOSITE RECTANGULAR JEWELRY STRUCTURE

CROSS-REFERENCE TO RELATED PATENT APPLICATION

This application is based on and claims priority to U.S. Provisional Patent Application 62/504,723, filed May 11, 2017, the entire contents of which is incorporated by reference herein as if expressly set forth in its respective entirety herein.

TECHNICAL FIELD

The present invention relates to jewelry articles and more particularly, to a jewelry article that is formed of a plurality of stones that are arranged so as to provide what visually appears to be a larger single stone.

BACKGROUND

This invention relates to a jewelry structure especially for rectangular or princess cut stones. Such structure may be employed in rings, pendants, earrings or the like.

One of the general objectives of retail jewelry sales is to provide customers with attractive jewelry items, especially those with reflective stones such as diamonds.

Conventional rectangular or princess cut stones generally have rectangular or square shapes and are held in prongs in jewelry.

Larger stones generally cost more money and therefore, there is a need to provide jewelry articles that have an appearance of a larger gemstone but at reduced costs.

SUMMARY

The apparent size of a stone can be enhanced and techniques to accomplish this objective have been employed. The present invention is directed to such a technique for presenting an apparently larger rectangular stone set in a setting which is comprised of a center stone and smaller outer rectangular stones offset outwardly around the perimeter of the center stone.

A method for creating an apparent visual appearance of a large rectangular gemstone in a setting comprising the steps of: mounting a plurality of outer stones along sides and ends of a setting; and mounting a rectangular shaped center stone in a first plane that lies above a second plane that contains the plurality of outer stones, the center stone being disposed within a center of the plurality of outer stones and in a partially overlapping manner such that an appearance of the center stone and the underlying outer stones emulates an appearance of an emerald cut gemstone having larger dimensions than the center stone.

BRIEF DESCRIPTION OF THE DRAWING FIGURES

DETAILED DESCRIPTION OF CERTAIN EMBODIMENTS

Figure 2:
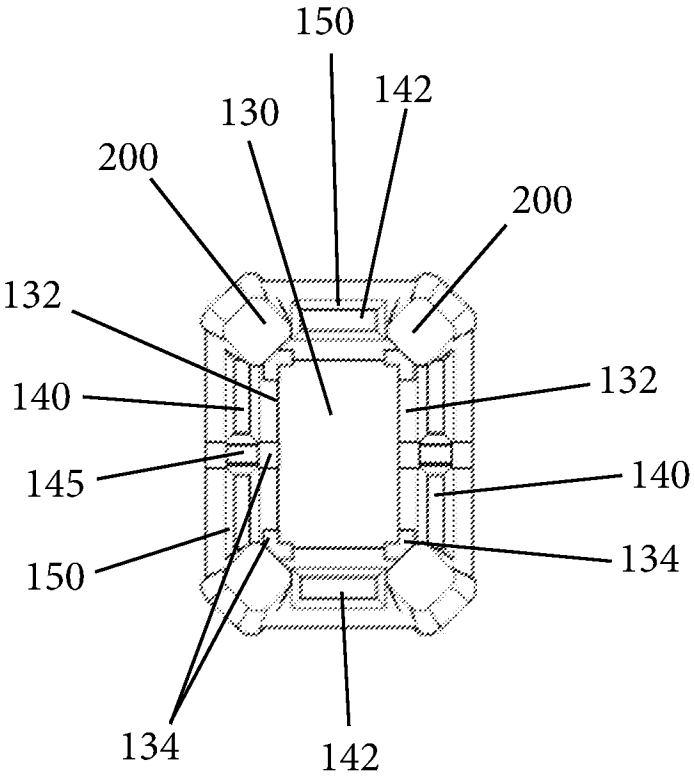
FIG. 2 is top plan view thereof.
Figure 1:
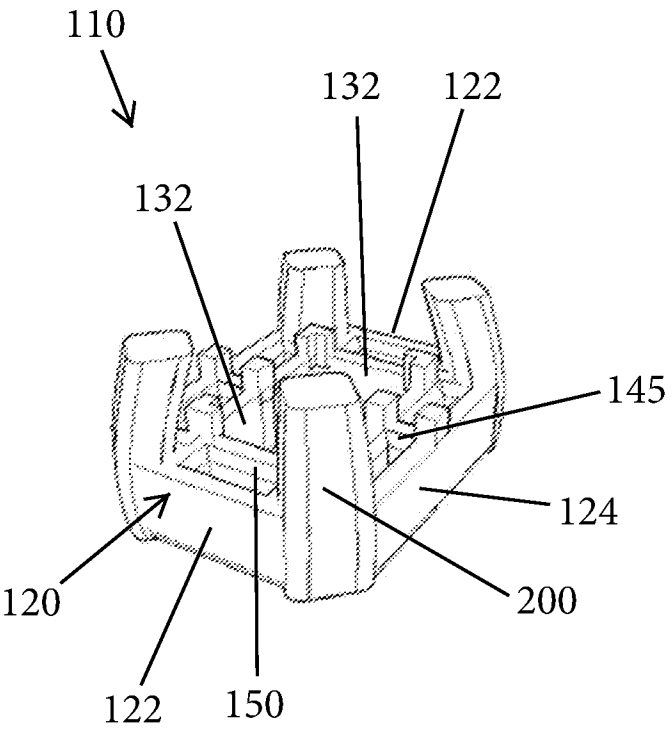
FIG. 1 is side and end perspective view of a setting according one embodiment with the stones being removed.
Figure 4:
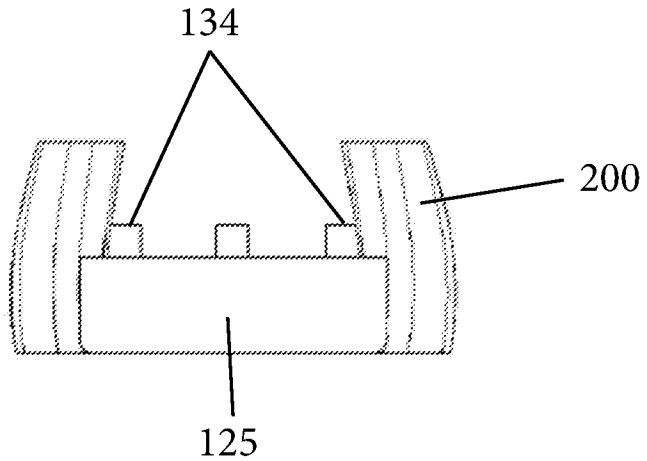
FIG. 4 is a side elevation view thereof.
Figure 5:
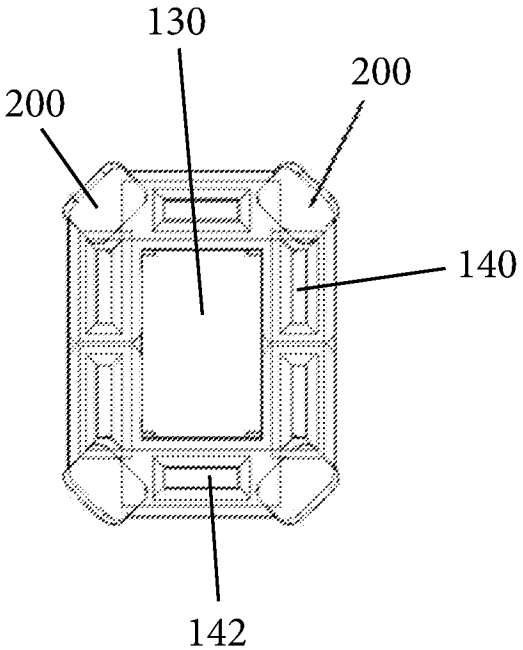
FIG. 5 is a bottom plan view thereof.
Figure 3:
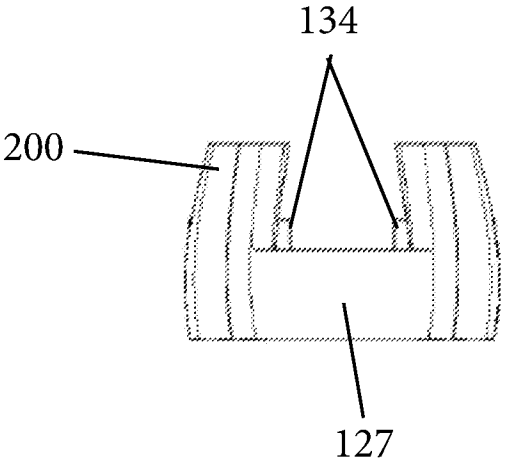
FIG. 3 is an end elevation view thereof.
Figure 7:
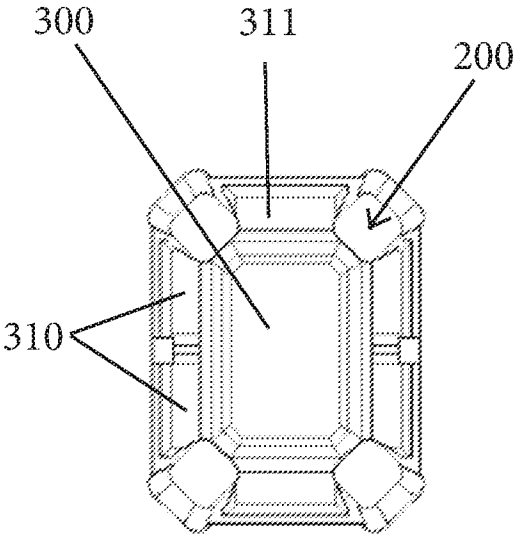
FIG. 7 is top plan view thereof.
Figure 6:
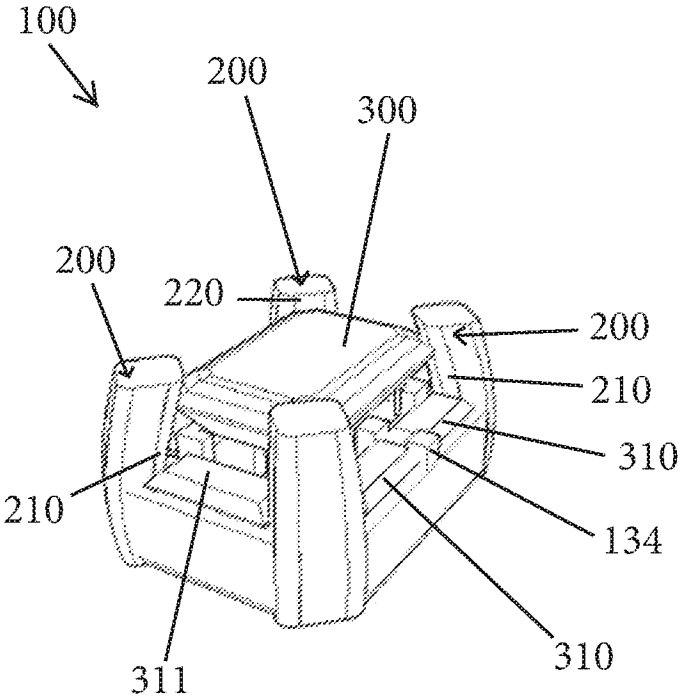
FIG. 6 is side and end perspective view of the setting with a center rectangular emerald cut stone surrounded by smaller rectangular baguette cut stones, all of which together present a uniform larger gemstone appearance than that of the center stone itself since the reflective quality of the stones allows achievement of an enhanced and larger appearance for the stone arrangement.
Figure 9:
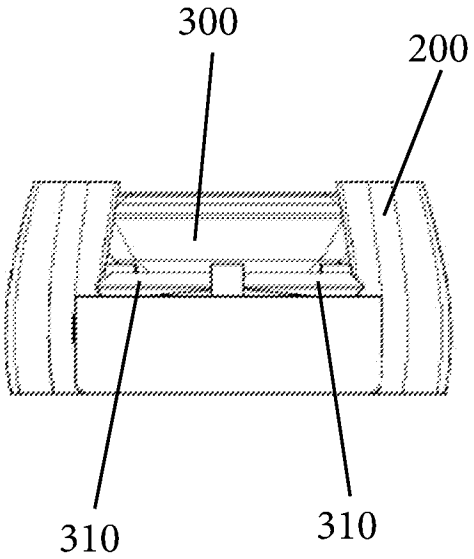
FIG. 9 is a side elevation view thereof.
Figure 8:
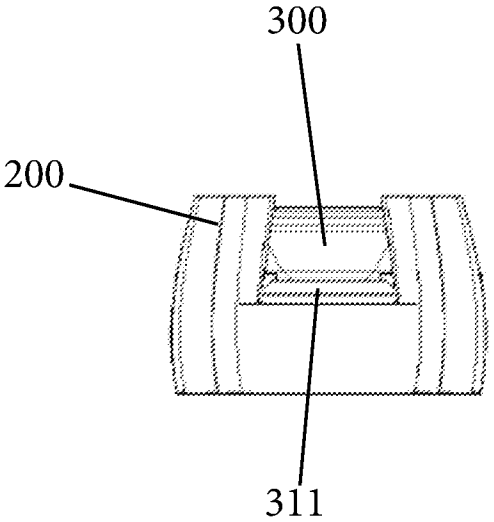
FIG. 8 is an end elevation view thereof.
Figure 11:
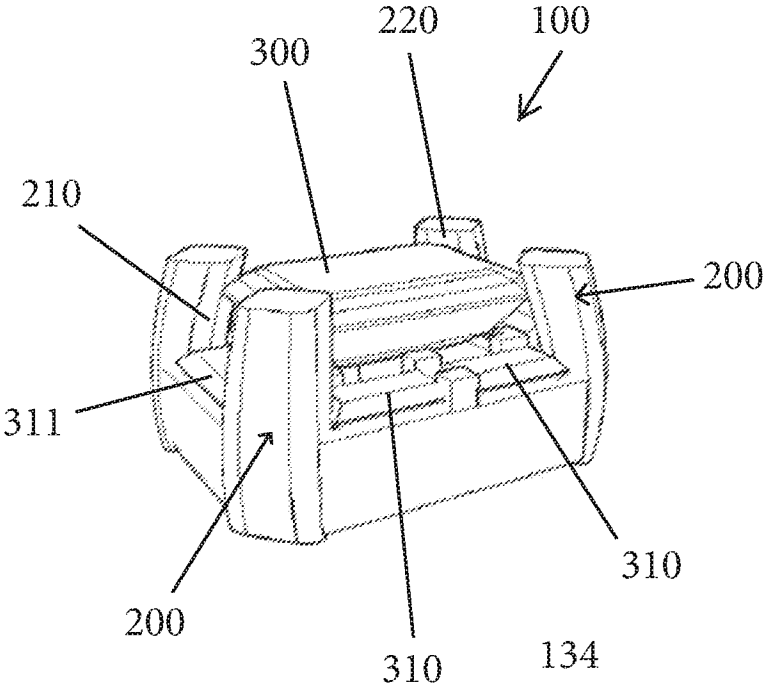
FIG. 11 is another side perspective view thereof.
Figure 10:
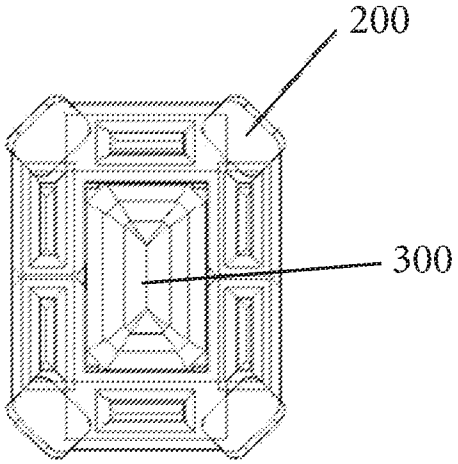
FIG. 10 is a bottom plan view thereof.

As is well known, there are many different types of jewelry articles (products) that are commercially available. For example, some of the more popular jewelry articles include, but are not limited to, rings, necklaces, bracelets, earrings. At a high level, a jewelry article can consist of one or more stones and a supporting structure that holds the one or more stones. The supporting structure varies depending upon the type of jewelry article. For example, in the case of a ring, a ring consists of a skank which is also known as a band. The shank is divided into the upper and lower shanks. The head, which is sometimes referred to as the setting, is the piece that holds the center stone in the ring. It's made up of the prongs and the piece to which they're attached. It forms the design of the mounting. The prongs are the small metal pieces that hold the stone in place. Solitaire diamonds usually have 4-6 prongs. The more prongs you have, the more secure the stone is; however, more prongs can obscure the stone more. The gallery is the back part of the ring that fits over the top of the finger. A ring with a large stone often features a hollow gallery so that there's more room for the stone and your finger. The shoulder of the ring is the top two sides of the ring. Some rings also have a bridge. In terms of the stone or stones that are present, a center stone, as the name implies, is the main stone in a solitaire. An engagement ring likely has a diamond as its center stone. Side stones are stones that are on either side of the center stone.

As is also known, there are also many different types of gemstone cuts. Most diamonds, as well as other stones, are round, square (cushion), rectangular (princess, Asscher, emerald, radiant), heart-shaped, pear-shaped, oval, or marquise (like a pear but pointed on both ends).

Only approximately three percent of the diamonds in the world are emerald cut; however, they are prized and widely sought after since they are gorgeous, distinct, and have an unmatched vintage look. A rectangular emerald cut diamond has several rows of stepped facets on its crown and pavilion, which run parallel to the girdle. Like most other diamond shapes, it typically has 57 or 58 facets.

In accordance with the present invention and with reference to the figures, a jewelry article 100 (FIGS. 6-11) is provided and is constructed so as to visually present an apparently larger rectangular stone set in a setting which is comprised of a center stones and smaller side stones (outer rectangular stones) that are offset outwardly around the perimeter of the center stone, resulting in enhancement of the apparent size of the stone.

It will be understood that the jewelry article and the method described herein for providing an enhanced apparent size of the stone can be implemented in many different types of specific jewelry articles including rings, pendants, necklaces, bracelets, etc.

For purpose of illustration only, FIGS. 1-5, only illustrate a head (setting/basket) 110 of the jewelry article 100. The head 110 has a bottom wall structure 120 that is generally rectangular in shape and defined by a pair of opposing ends 122 and a pair of opposing sides 124, with the length of the sides 124 being greater than the lengths of the ends 122. The sides 124 are defined by side walls 125 and the ends 122 are defined by end walls 127.

The bottom wall structure 120 includes a number of rails that are arranged and joined together to form a plurality of openings (through holes). In particular, the head 110 has a main center opening 130 that has a rectangular shape and is defined by a plurality of inner rails 132. Along the tops of the inner rails 132 there a plurality of pillars 134 that protrude upwardly and can have a square shape as shown. Pillars 134 can be thought of as being secondary prongs. For example, the pillars 134 can be located in the four corners (as L-shaped pillars) and can be located at a center point of each of the two sides 124. Between the inner rails 132 and the outer side walls 125 there are a plurality of side openings 140 and similarly, between the inner rails 132 and the outer end walls 127 there are a plurality of end openings 142. As shown in the figures, the side openings 140 and end openings 142 have rectangular shapes and as described below, receive side stones. As shown, each of the side openings 140 and end openings 142 can be defined by beveled (angled) inner edges 150 that complement the shape of the side stones as discussed below. In the illustrated embodiment, along each of the sides 124, there are two side openings 140 and along each of the ends 122, there is a single end opening 142. Along the side 124, there is separating wall 145 that extends between the inner rail 132 and the outer side wall 125 to separate the two side openings 140. As shown, the outer side wall 125 can also include one pillar 134 located at a center point spaced from but aligned with pillar 134 on the inner rail 132. These two pillars 134 are thus at the two ends of the separating wall 145. The tops of the pillars 134 all preferably lie in the same plane.

At the four corners of the head 110 there are prongs 200. Each prong 200 extends upwardly and as shown, each prong 200 can be curved such that an inner surface and outer surface thereof are both curved in an inward direction toward the main center opening 130. Prongs 200 function as traditional prongs in that they are configured and designed to hold the stone. As shown in the figures, the bottom ends of the prongs 200 can extend slightly below the underside of the side walls 125 and end walls 127. In addition, in one embodiment, the inner wall surface 210 of the prong 200 can have a cut (outwardly angled beveled cut) formed therein (such that a width of the prong at this cut portion is less than the top which can receive side stones for holding ends of the side stones in place.

In accordance with the present invention and shown in FIGS. 6-11, the stones used in the jewelry article 100 includes a center stone 300 which is rectangular shaped and can be in the form of a center princess cut stone or a center emerald cut stone (e.g., a center emerald cut diamond). The center stone 300 is held by the prongs 200 and more particularly, the center stone 300 is held in its four corners by four corresponding interior surfaces 220 of the prongs 200. The center stone 300 is thus held in a suspended state above the bottom wall structure 120. In one embodiment, the underside of the center stone 300 is located proximate to but not in touching contact with the tops of the pillars 134.

Located below the center stone 300 there are a plurality of side or outer stones 310 and outer end stones 311. The side stones 310 and end stones 311 are preferably cut similarly to the shape of the center stone 300 and are offset slightly outwardly and are below the center stone 300. The main center stone 300 thus represents an upper stone lying in one plane (an upper plane), while the side stones 310 and end stones 311 represent lower stones lying in another plane (a lower plane). In the illustrated embodiment, each of the side stones 310 and end stones 311 is in the form of a straight baguette cut stone (e.g., baguette diamond).

Each of the side stones 310 is laid into one of the respective side openings 140 or and each of the end stones 311 is laid into one of the respective end openings 142 and is held in place at least partially by one of prongs 200. More specifically, the end stones 311 positioned at the ends 122 of the setting 120 are disposed over the end openings, with one end of the end stone 311 engaging one prong 200 in one corner and the other end of the end stone 311 engaging the other prong 200 in the other corner that defines the end 122. In addition, the cut of the end stone 311 and side stones 310 (e.g., baguette cut) is complementary to the beveled side edges 150 to allow the baguette cut stone to securely seat therein and be retained at its ends by the two prongs 200.

In the case of the side stones 310 that are disposed along the sides 124, at least one end of each stone 310 is held in place by one respective prong 200, while the other end of the stone 310 engages one of the pillars 134 that acts as a secondary prong. The two stones 310 on the sides 124 are thus positioned in an end-to-end manner. It will also be understood that the single stone 310 at the end 122 can be larger in size than one of the stones 310 that is located along the side 124.

It will be seen that the side stones 310 and end stones 311 do not rise above the tops of the pillars 134 (secondary prongs) and thus, these outer side stones 310 and end stones 311 are nested below the pillars 134 and lie in a second plane that is spaced from and located below the plane containing the center stone 300. A small space can thus be formed between the center stone 300 and stones 310, 311.

The top center stone 300 can at least partially overlap inner portions of the side stones 310 and end stones 311.

If desired, offset outer side stones 310 can be set closer to and support the center stone 300 leaving little or no space between the upper and lower stones. This setting technique mat provide enhanced visual appearance of a large rectangular stone than center stone 300 by itself.

The lower side stones 310 can be comprised of a single rectangular stone rather than two edge-to-edge stones or could comprise more than two stones so long as the resulting shape of the outer stones is rectangular. The outer stones enlarge the visual appearance by extending the length and width apparent dimensions of the center stone 300 without changing the overall visual appearance of the rectangular or square stone. The outer side and end stones 310, 311 are parallel to the side 124 and ends 122 and form width or length extensions.

The center stone 300 is shown are rectangular but could also be square.

The present invention is directed to rectangular stones (princes, emerald, etc.) and to the specific arrangements for upper and lower sets of stones to provide a larger gemstone (diamond) appearance to the ordinary observer. This composite stone's larger appearance is made up of smaller less expensive stones thereby creating an apparent greater value than if the single center stone was set by itself. On the other hand, a single rectangular or square stone having the apparent size of the composite stone of the present invention would be much more expensive than center stone of the present invention.

It will also be understood that the setting (head) 110 can be formed of any number of suitable materials, including metals.

Inner surfaces of the prongs 200 are thus configured to seat against a corner of the center stone 300. For example, angled cut edges of the center stone 300 can seat against a flat formed along the inner surface of the prongs 200.

In one embodiment, at least a substantial portion (e.g., greater than 50% or greater than 75%) of the side stones 310 and end stones 311 extend beyond the peripheral edge of the center stone 300.

Figure 13:
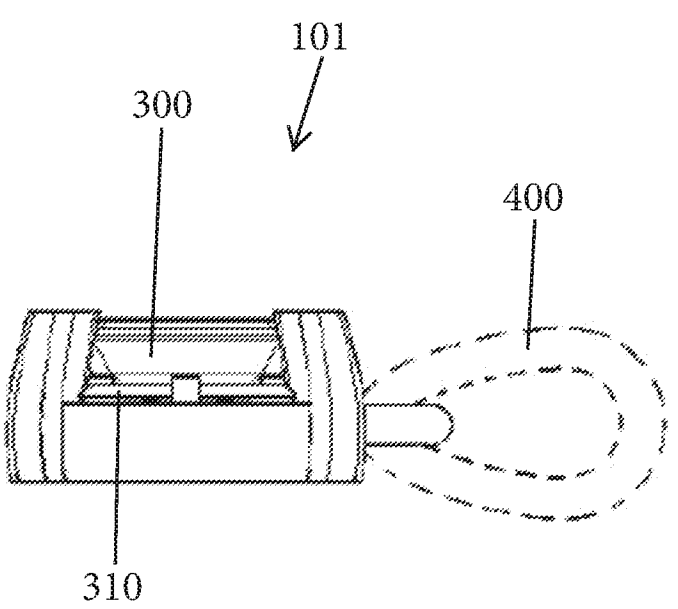
FIG. 13 is a side elevation view thereof.
Figure 12:
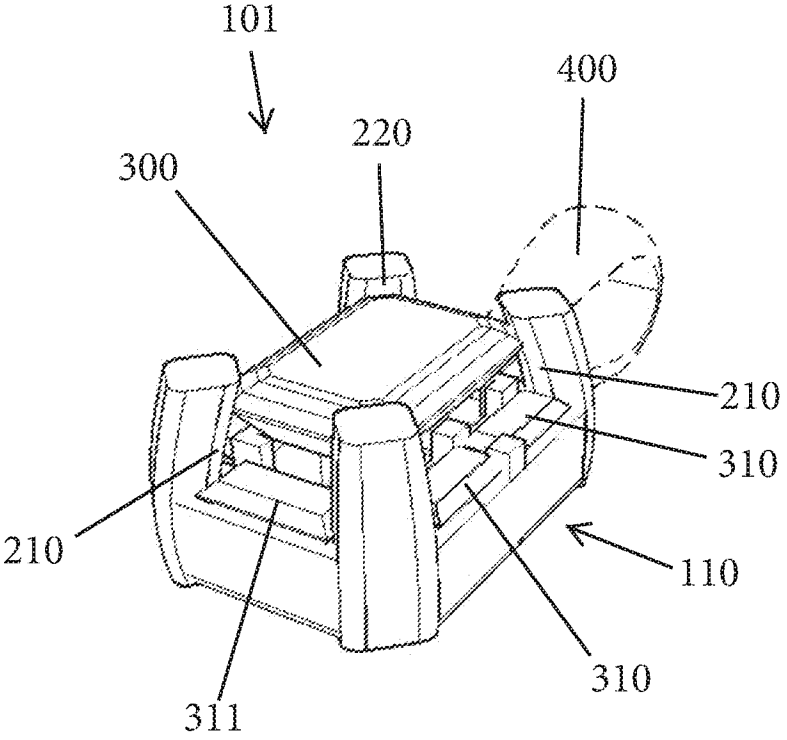
FIG. 12 is a side perspective view of a pendant incorporating the setting and stones of FIG. 6.

FIGS. 13-14 illustrate a jewelry article 101 in the form of a pendant which utilizes the head 110 with stones 300, 310 and further includes a bail 400 that is the part that goes over a chain to hold the piece to the chain.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed:

1. A jewelry article comprising:

a setting including a plurality of first prongs; and a plurality of gemstones including a first stone that lies in a first plane and a plurality of second stones that lie in a second plane below the first plane, the plurality of second stones extending outwardly beyond a periphery of first stone such that the plurality of second stones are at least partially laterally offset from the first stone;

wherein the first stone is held in place by the plurality of first prongs and the plurality of second stones are at least partially held in place by the plurality of first prongs;

wherein the plurality of second stones are arranged such that a table of each of the second stones faces upward in a direction toward the first stone.

2. The jewelry article of claim 1, wherein the first stone comprises a rectangular cut stone and each of the plurality of second stones comprises a rectangular cut stone that is smaller than the first stone.

3. The jewelry article of claim 2, wherein the first stone comprises a center emerald cut stone and each of the plurality of second stones comprises a straight baguette cut stone.

4. The jewelry article of claim 1, wherein the plurality of second stones comprises a pair of end stones that are arranged along opposing ends of the first stone and a plurality of side stones that are arranged along opposing sides of the first stone.

5. The jewelry article of claim 4, wherein there are two side stones arranged along each side of the first stone, the two side stones being arranged in an end-to-end orientation.

6. The jewelry article of claim 4, wherein the end stones have greater dimensions than the side stones.

7. The jewelry article of claim 1, wherein the setting includes a center opening over which the first stone is positioned and a plurality of secondary openings that are formed radially outside and extending along a periphery of the center opening, the plurality of second stones being disposed over the plurality of secondary openings.

8. The jewelry article of claim 7, wherein the secondary openings are defined by beveled side edges.

9. The jewelry article of claim 1, further including a plurality of second prongs for holding the plurality of second stones in place in combination with the first prongs.

10. The jewelry article of claim 1, wherein an appearance of the first stone and the underlying second stones emulates an appearance of an emerald cut gemstone having larger dimensions than the first stone.

11. The jewelry article of claim 1, wherein the first stone is spaced above and free of contact with the plurality of second stones.

12. The jewelry article of claim 1, wherein the setting further comprises a main center opening which receives the first stone, wherein the first set of prongs each have an inner wall surface and an outer wall surface and wherein the inner and outer wall surfaces curve in an inward direction toward the main center opening.

13. The jewelry article of claim 1, wherein the first stone is held at corners thereof by corresponding interior surfaces of the plurality of first prongs in the first plane, and wherein the first prongs have cuts in inner wall surfaces thereof each sized to receive one end of a respective one of the plurality of second stones sized to receive and hold the second stone in place in the second plane below the first plane, and wherein the interior surfaces are different surfaces than the inner wall surfaces.

14. The jewelry article of claim 1, wherein each of the plurality of first prongs has multiple surfaces and wherein the first stone and the second stones are engaged at different ones of the multiple surfaces.

15. A jewelry article comprising:

a setting including a plurality of first prongs; and a plurality of gemstones including a first stone that lies in a first plane and a plurality of second stones that lie in a second plane below the first plane, the plurality of second stones extending outwardly beyond a periphery of first stone such that the plurality of second stones are at least partially laterally offset from the first stone;

wherein the first stone is held in place by the plurality of first prongs and the plurality of second stones are at least partially held in place by the plurality of first prongs;

a plurality of second prongs for holding the plurality of second stones in place in combination with the first prongs;

wherein one end of each second stone seats against two second prongs and an opposite end of the second stone seats against one first prong.

16. The jewelry article of claim 15, wherein the plurality of second prongs comprises a plurality of pillars that protrude upwardly from a top edge of a bottom section of the setting.

17. The jewelry article of claim 16, wherein the pillars have square shapes and are linear elongated structures, the first prongs being inwardly curved structures.

18. A jewelry article comprising:

a setting including a plurality of first prongs; and a plurality of gemstones including a first stone that lies in a first plane and a plurality of second stones that lie in a second plane below the first plane, the plurality of second stones extending outwardly beyond a periphery of first stone such that the plurality of second stones are at least partially laterally offset from the first stone; wherein the first stone is held in place by the plurality of first prongs and the plurality of second stones are at least partially held in place by the plurality of first prongs;

wherein the setting includes a center opening over which the first stone is positioned and a plurality of secondary openings that are formed radially outside and extending along a periphery of the center opening, the plurality of second stones being disposed over the plurality of secondary openings;

wherein each secondary opening is defined by and between an inner rail structure that defines the center opening and side and end walls of the setting.

19. A method for creating an apparent visual appearance of a large rectangular gemstone in a setting comprising the steps of:

mounting a plurality of outer stones along sides and ends of a setting; and mounting a rectangular shaped center stone in a first plane that lies above a second plane that contains the plurality of outer stones, the center stone being disposed within a center of the plurality of outer stones and in a partially overlapping manner such that an appearance of the center stone and the underlying outer stones emulates an appearance of an emerald cut gemstone having larger dimensions than the center stone.

20. The method of claim 19, wherein the center comprises a center emerald cut stone and the outer stones comprise baguette cut stones.

* * * * *